US008532508B2

(12) United States Patent
Kurita

(10) Patent No.: US 8,532,508 B2
(45) Date of Patent: Sep. 10, 2013

(54) IMAGE FORMING APPARATUS AND IMAGE FORMING METHOD FOR FORMING AN IMAGE AT DIFFERENT IMAGE FORMING SPEEDS

(75) Inventor: Hiroshi Kurita, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 360 days.

(21) Appl. No.: 13/019,081

(22) Filed: Feb. 1, 2011

(65) Prior Publication Data

US 2012/0051764 A1 Mar. 1, 2012

(30) Foreign Application Priority Data

Aug. 31, 2010 (JP) ..... 2010-193601

(51) Int. Cl.
*G03G 15/00* (2006.01)

(52) U.S. Cl.
USPC ..... 399/43; 399/82

(58) Field of Classification Search
USPC ..... 399/43, 82, 85, 94
See application file for complete search history.

(56) References Cited

U.S. PATENT DOCUMENTS 7,136,089 B2 * 11/2006 Able et al. ..... 399/43
7,664,420 B2 * 2/2010 Oominami et al. ..... 399/85
8,107,845 B2 * 1/2012 Nonaka ..... 399/82

FOREIGN PATENT DOCUMENTS

JP 2004-118028 A 4/2004

* cited by examiner

*Primary Examiner* — William J Royer
(74) *Attorney, Agent, or Firm* — Sughrue Mion, PLLC

(57) ABSTRACT

An image forming apparatus includes an image forming unit that forms an image on a sheet; a receiving unit that receives a command that makes the image forming unit form an image; and a controller that controls the image forming unit so that the image forming unit forms an image on a sheet at a first image forming speed if a number of sheets on which images are to be formed due to the command is larger than a threshold and controls the image forming unit so that the image forming unit forms an image at a second image forming speed if a number of sheets is equal to or smaller than the threshold, the second image forming speed being higher than the first image forming speed.

7 Claims, 5 Drawing Sheets

IMAGE FORMING APPARATUS AND IMAGE FORMING METHOD FOR FORMING AN IMAGE AT DIFFERENT IMAGE FORMING SPEEDS

CROSS-REFERENCE TO RELATED APPLICATIONS

This application is based on and claims priority under 35 USC 119 from Japanese Patent Application No. 2010-193601 filed Aug. 31, 2010.

BACKGROUND

(i) Technical Field

The present invention relates to an image forming apparatus and an image forming method.

SUMMARY

According to an aspect of the invention, an image forming apparatus includes an image forming unit that forms an image on a sheet; a receiving unit that receives a command that makes the image forming unit form an image; and a controller that controls the image forming unit so that the image forming unit forms an image on a sheet at a first image forming speed if a number of sheets on which images are to be formed due to the command is larger than a threshold and controls the image forming unit so that the image forming unit forms an image at a second image forming speed if a number of sheets is equal to or smaller than the threshold, the second image forming speed being higher than the first image forming speed.

BRIEF DESCRIPTION OF THE DRAWINGS

An exemplary embodiment of the present invention will be described in detail based on the following figures, wherein.

DETAILED DESCRIPTION

Hereinafter, an exemplary embodiment of the present invention will be described with reference to the drawings.

Image Forming Apparatus 1

Figure 1:
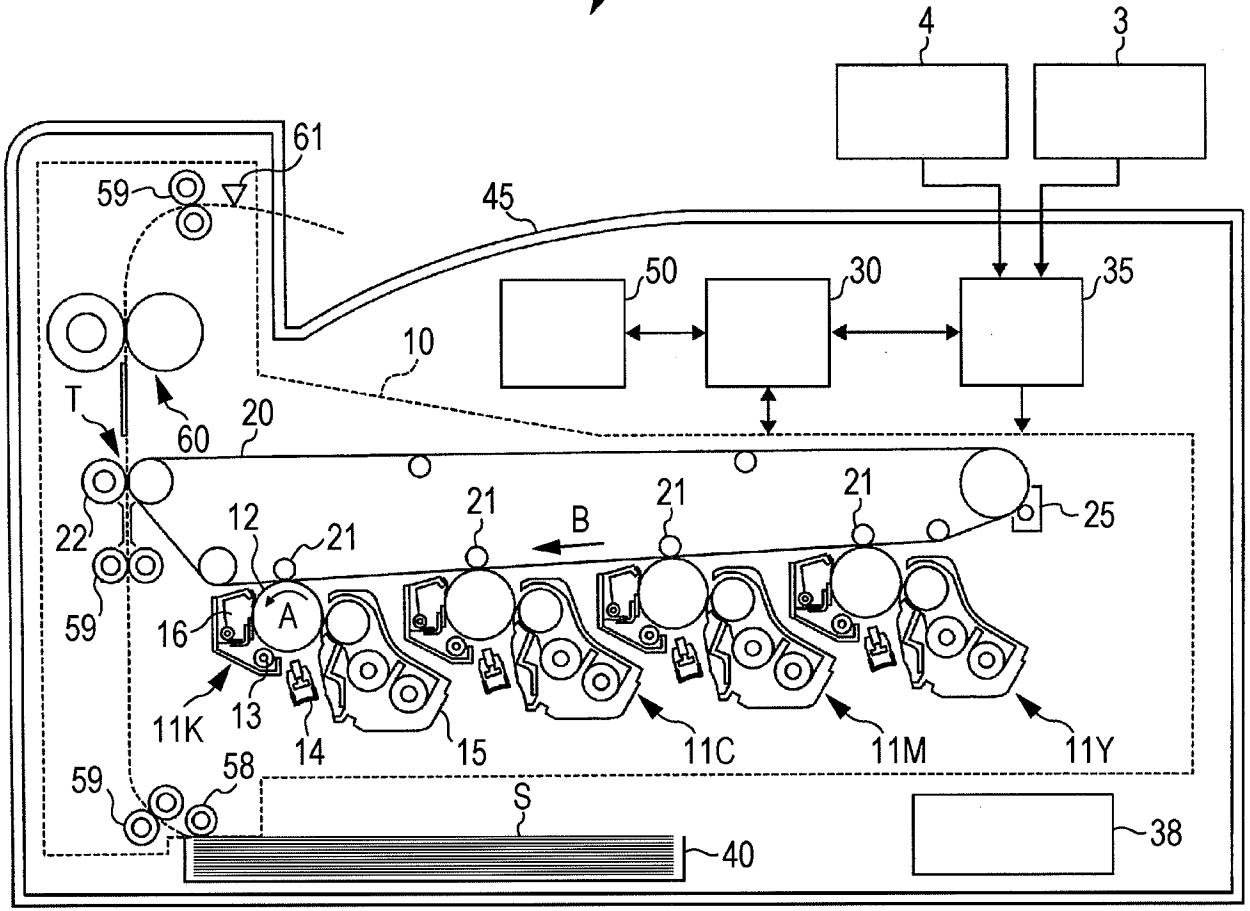
FIG. 1 is a schematic view of an image forming apparatus according to an exemplary embodiment of the present invention.

FIG. 1 is a schematic view of an image forming apparatus 1 according to the present exemplary embodiment. The image forming apparatus 1 illustrated in FIG. 1 is a so-called tandem-type color printer. The image forming apparatus 1 includes an image forming section 10 and a controller 30. The image forming section 10 forms an image in accordance with image data for different colors. The controller 30 controls the overall operation of the image forming apparatus 1. The image forming apparatus 1 includes an image processing unit 35 that is connected to an external apparatus, such as a personal computer (PC) 3 or an image reading apparatus 4. The image processing unit 35 performs predetermined image processing on image data that is received from the external apparatus. The image forming apparatus 1 includes a power supply 38, a sheet stacker 40, and a user interface 50. The power supply 38 supplies electric power to components of the image forming apparatus 1. The sheet stacker 40 holds sheets S that are supplied to the image forming section 10. The user interface 50 receives an instruction that is input by a user. The image forming apparatus 1 further includes an output sheet stacker 45 that holds the sheets S on which images have been formed by the image forming section 10.

Image Forming Section 10

The image forming section 10 includes four image forming units 11Y, 11M, 11C, and 11K (also referred to as "image forming units 11"), which are parallely disposed at regular intervals. Each of the image forming units 11 includes a photoconductor drum 12 and a charger 13. The photoconductor drum 12 forms an electrostatic latent image and holds a toner image. The charger 13 uniformly charges the surface of the photoconductor drum 12 to a predetermined potential. Each of the image forming units 11 includes an exposure device 14 and a developing device 15. The exposure device 14 exposes the photoconductor drum 12, which has been charged by the charger 13, to light in accordance with image data. The developing device 15 develops an electrostatic latent image that is formed on the photoconductor drum 12. Each of the image forming units 11 includes a cleaner 16 that cleans the surface of the photoconductor drum 12 after the transfer is finished.

The image forming units 11 are substantially the same except for the toner contained in the developing devices 15 thereof. The image forming units 11Y, 11M, 11C, and 11K respectively form yellow (Y), magenta (M), cyan (C), and black (K) toner images.

The image forming section 10 includes an intermediate transfer belt 20. The color toner images, which have been formed on the photoconductor drums 12 of the image forming units 11, are multilayer-transferred to the intermediate transfer belt 20. The image forming section 10 includes first transfer rollers 21. The first transfer rollers 21 successively transfer (first-transfers) the color toner images, which have been formed by the image forming units 11, to the intermediate transfer belt 20. The image forming section 10 includes a second transfer roller 22 and a fixing device 60. The second transfer roller 22 simultaneously transfers (second-transfers) the color toner images, which have been formed on the intermediate transfer belt 20 in a superimposed manner, onto a sheet S, which is a recording medium (recording sheet). The fixing device 60 fixes the color toner images onto the sheet S.

The image forming section 10 include a pickup roller 58 and transport rollers 59. The pickup roller 58 successively feeds the sheets S, which are stacked on the sheet stacker 40. The transport rollers 59 transport the sheet S that has been fed by the pickup roller 58. The image forming section 10 includes an exit sensor 61. The exit sensor 61 detects passing of the sheet S onto which the fixing device 60 has fixed a toner image.

When image data is input from the PC 3 or the image reading apparatus 4 to the image forming apparatus 1 of the present exemplary embodiment, the image processing unit 35 performs predetermined image processing on the image data, and the image data is sent to the image forming units 11 through an interface (not shown). Then, in the image forming unit 11K for forming a black (K) color toner image, for example, the photoconductor drum 12 rotates in the direction of arrow A, the charger 13 uniformly charges the photoconductor drum 12 to a predetermined potential, and the exposure device 14 scan-exposes the photoconductor drum 12 on the basis of the image data sent from the image processing unit 35. Thus, an electrostatic latent image corresponding to a black (K) image is formed on the photoconductor drum 12. The developing device 15 develops the electrostatic latent image formed on the photoconductor drum 12, and a black (K) toner image is formed on the photoconductor drum 12. Likewise, yellow (Y), magenta (M), and cyan (C) toner images are formed by the image forming units 11Y, 11M, and 11C, respectively.

The color toner images, which have been formed by the image forming units 11, are successively attracted by the first transfer rollers 21 and transferred to the intermediate transfer belt 20, which is moving in the direction of arrow B, so that a superimposed toner image, in which color toner images are superimposed, is formed on the intermediate transfer belt 20. As the intermediate transfer belt 20 moves, the superimposed toner image formed on the intermediate transfer belt 20 is transported to a region (second transfer region T) in which the second transfer roller 22 is disposed.

The pickup roller 58 feeds the sheets S that are stacked on the sheet stacker 40. The transport rollers 59 supply the sheet S, which has been fed by the pickup roller 58, to the second transfer region T at the same time as the superimposed toner image is transported to the second transfer region T. In the second transfer region T, the superimposed toner image is simultaneously and electrostatically transferred to the sheet S, which has been transported by the transport rollers 59, due to the transfer electric field that is produced by the second transfer roller 22.

Then, the sheet S, on which the superimposed toner image has been electrostatically transferred, is peeled off the intermediate transfer belt 20, and transported to the fixing device 60. The fixing device 60 fixes the toner image onto the sheet S, which has been transported to the fixing device 60, onto the sheet S by using heat and pressure. The transport rollers 59 further transport the sheet S onto which the toner image has been fixed. Then, the exit sensor 61 detects passing of the S sheet, and the sheet S is stacked on the output sheet stacker 45 that is disposed in the output section of the image forming apparatus 1.

After the second transfer is finished, toner (residual toner) that adheres to the intermediate transfer belt 20 after the second transfer is removed by a belt cleaner 25 from the surface of the intermediate transfer belt 20, so that the image forming section 10 becomes ready to perform the next image forming cycle.

The image forming apparatus 1 repeats the image forming cycle for the number of sheets to be printed.

The image forming apparatus 1 according to the present exemplary embodiment performs an image forming operation as a printer or a copier.

The image forming apparatus 1 according to the present exemplary embodiment performs a multiple-color image forming operation and a single-color image forming operation on the sheet S. In the present exemplary embodiment, the term "multiple-color image forming operation" refers to an operation of forming an image using two or more colors among yellow (Y), magenta (M), cyan (C), and black (K). The colors are not limited thereto. In the present exemplary embodiment, the term "single-color image forming operation" refers to an operation of forming an image using one color among yellow (Y), magenta (M), cyan (C), and black (K). The colors are not limited thereto.

Modes of Image Forming Operation

Next, modes of the image forming operation performed by the image forming apparatus 1 according to the present exemplary embodiment will be described.

The image forming apparatus 1 according to the present exemplary embodiment has a normal mode and a high-speed mode for forming an image on the sheet S. The process speed is low in the normal mode, and the process speed is high in the high-speed mode.

In the present exemplary embodiment, the term "process speed" (an example of an image forming speed) refers to the reciprocal of the time (hereinafter referred to as "image forming time") from when the user interface 50 or the PC 3 (an example of a receiving unit) receives an image forming instruction (an example of a command) to when the sheet S on which an image has been formed is stacked on the output sheet stacker 45. Therefore, a low process speed corresponds to a long image forming time. Conversely, a high process speed corresponds to a short image forming time.

Because the process speed differs between the normal mode and the high-speed mode, the components of the image forming apparatus 1 each move at different speeds. For example, the rotation speed of the photoconductor drum 12, the scanning speed of the exposure device 14 in the main scanning direction, the rotation speed of the intermediate transfer belt 20, the rotation speed of the second transfer roller 22, and the rotation speed of the transport rollers 59 are different between the normal mode and the high-speed mode.

Hereinafter, the high-speed mode and the normal mode will be described.

High-Speed Mode

As described above, in the high-speed mode, the process speed is higher than that of the normal mode, and the image forming time is shorter than that of the normal mode. In other words, the productivity is higher in the high-speed mode than in the normal mode. In the present exemplary embodiment, a "higher productivity" refers to a fact that the same image is formed in a shorter image forming time.

The high-speed mode is a mode that gives a higher priority to increasing the productivity in forming an image on the sheet S than to reducing the influence exerted by the image forming apparatus 1 on the surroundings of the image forming section 10 when forming the image. Hereinafter, the influence on the surroundings of the image forming section 10 in the high-speed mode, which is greater than that of the normal mode, will be described.

First, in the high-speed mode, the quantity of heat that is generated per unit time when the image forming section 10 forms an image is larger than that of the normal mode for the reasons described below. Therefore, in the high-speed mode, the temperature of the image forming section 10 increases by a larger degree per unit time than in the normal mode, or the temperature inside the image forming apparatus 1 increases by a larger degree per unit time than in the normal mode. If the temperature of the image forming section 10 or the temperature inside the image forming apparatus 1 increases excessively, the quality of image formed on the sheet S may be reduced or a malfunction due to toner blocking may occur.

The quantity of heat generated by the image forming section 10 when forming an image differs between the high-speed mode and the normal mode for the following reasons.

First, in the high-speed mode, the components of the image forming section 10 move at higher speeds as described above. As the components move at higher speeds, frictional heat generated by friction between members of the components increase. As a result, the quantity of heat generated by the image forming section 10 increases.

Second, in the high-speed mode, the temperature of the fixing device 60 may be set higher than that of the normal mode. This is because, as the process speed is higher in the high-speed mode, the sheet S, on which a toner image has been electrostatically transferred, passes through the fixing device 60 in a shorter time. Thus, it is necessary that the temperature of the fixing device 60 be higher in the high-speed mode in order to supply the quantity of heat that is required by the fixing device 60 to fix the toner image stably. When the temperature of the fixing device 60 is high, the quantity of heat generated by the image forming section 10 increases.

In addition to the quantity of heat generated per unit time when the image forming section 10 forms an image, the amount of noise generated and the amount of power consumed when the image forming apparatus 1 operates are larger in the high-speed mode than in the normal mode for the following reasons.

First, the noise generated due to contacts between members of the units increase because the components move at higher speeds.

Second, the electric power consumed by driving units (not shown) for driving the components increases in order to increase the moving speeds of the units. Third, when the temperature of the fixing device 60 is set higher in the high-speed mode as described above, additional electric power is required to increase the temperature of the fixing device 60.

Normal Mode

The process speed is lower in the normal mode than in the high-speed mode.

On the other hand, in the normal mode, the increase in the temperature of the image forming section 10 or the increase in the temperature inside the image forming apparatus 1 is smaller and the amount of noise generated and the amount of power consumed are smaller than those in the high-speed mode.

The normal mode is a mode that gives a higher priority to reducing the influence exerted on the surroundings by the image forming section 10 when forming an image than to increasing the productivity in forming an image on a sheet.

Mode Selection

Figure 2:
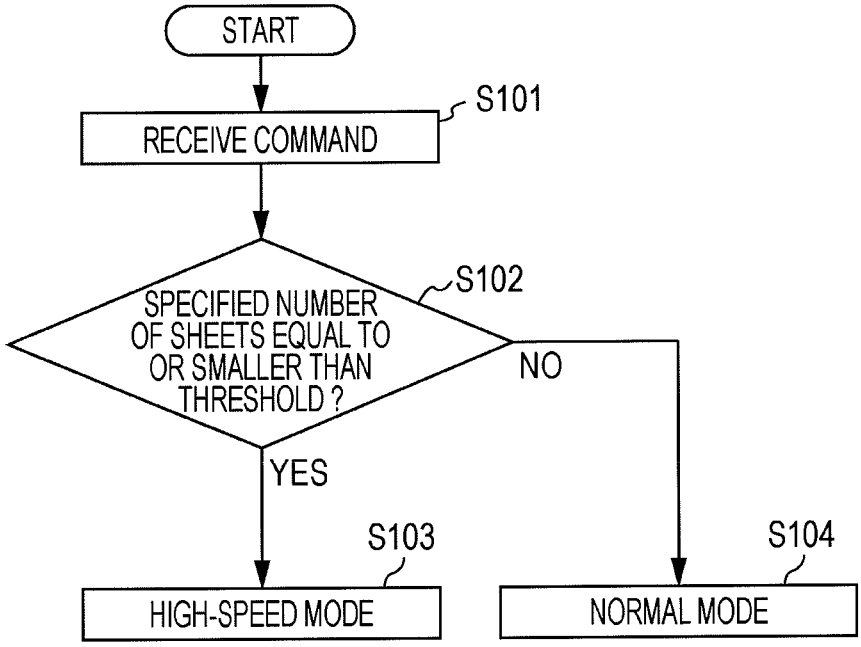
FIG. 2 is a flowchart representing a process of selecting a mode of image forming operation.

Next, referring to FIG. 2, the process of selecting a mode of image forming operation performed by the image forming apparatus 1 will be described. FIG. 2 is a flowchart representing the process of selecting a mode of image forming operation performed by the image forming apparatus 1, which is performed by the controller 30.

When the image forming apparatus 1 is not performing an image forming operation, the controller 30 receives an instruction related to an image forming operation, which is input by a user through the PC 3 or the user interface 50 (step S101). The controller 30 checks the instruction received in step S101, and determines whether or not a specified number of sheets, which is the number of sheets on which images are to be formed, is equal to or smaller than a threshold (step S102). If the determination in step S102 is "YES", the controller 30 makes the image forming apparatus 1 perform an image forming operation in the high-speed mode, which gives a higher priority to increasing the productivity than to reducing the influence exerted by the image forming section 10 on the surroundings (step S103). If the determination is step S102 is "NO", the controller 30 makes the image forming apparatus 1 perform an image forming operation in the normal mode, which gives a higher priority to reducing the influence exerted by the image forming section 10 on the surroundings than to increasing the productivity (step S104).

In the present exemplary embodiment, the threshold is an integer that is equal to or larger than 1. The value of the threshold is changeable. The threshold is set, for example, when the user interface 50 receives an instruction input by a user before the image forming apparatus 1 performs an image forming operation.

For example, the threshold may set at the number of sheets that is most frequently used by the image forming apparatus 1. To be specific, it is assumed that the specified number of sheets in the range of zero to five is used for 90% of the cases. In this case, if the threshold is set at five, the image forming apparatus 1 performs an image forming operation in the high-speed mode when the specified number of sheets is in the range from zero to five. Therefore, in most cases of using the image forming apparatus 1, the productivity is high.

Alternatively, the threshold may be set, for example, at one. If the threshold is set at one, the result of forming a test image is readily checked when forming the test image on one sheet in order to check the print quality.

An upper limit may be set on the value of the threshold. For example, if it has been known from test results that the quality of an image decreases or a malfunction due to toner blocking occurs when images are continuously formed on twenty or more sheets in the high-speed mode, only a value smaller than twenty may be accepted as a threshold.

The above-described process of selecting a mode of image forming operation, which is performed by the image forming apparatus 1, is performed when an instruction related to an image forming operation is received while the image forming apparatus 1 is not performing an image forming operation.

If the image forming apparatus 1 receives a new instruction related to an image forming operation while the image forming apparatus 1 is performing an image forming operation, the image forming operation related to the new instruction is performed in the normal mode after the current image forming operation (in the high-speed mode or in the normal mode) is finished.

Mode Selection During Image Forming Operation

Figure 3:
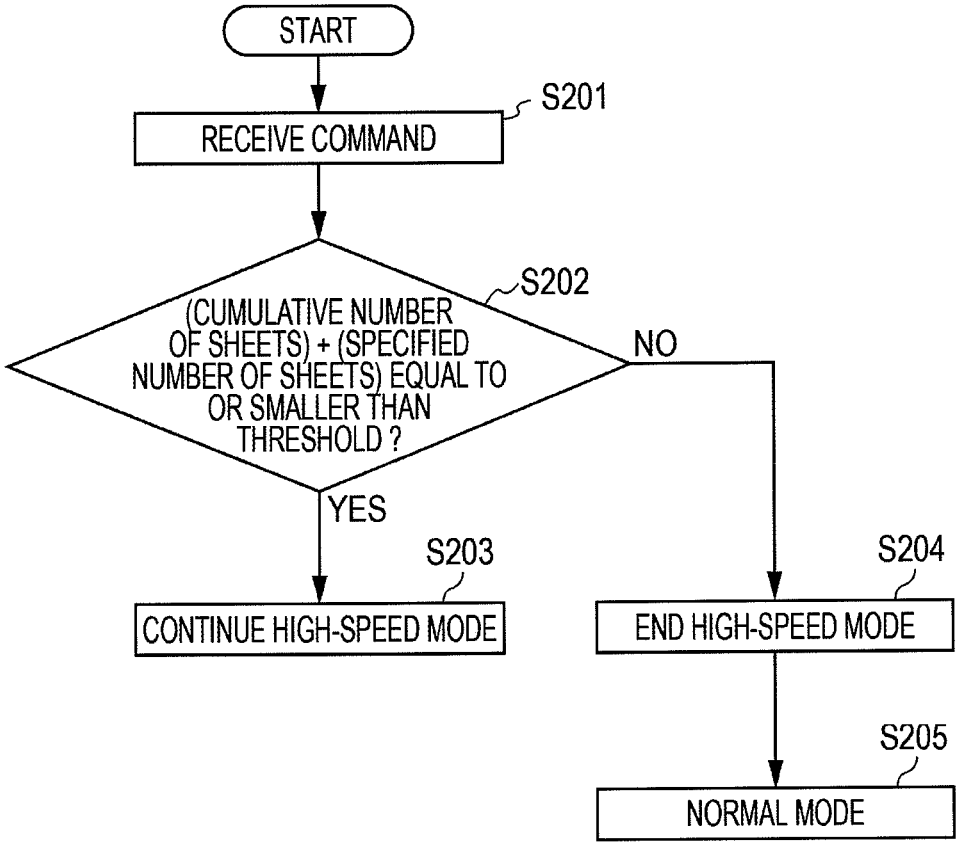
FIG. 3 is a flowchart representing a process of selecting a mode of image forming operation when the image forming apparatus receives a new instruction to perform an image forming operation while performing an image forming operation.

Referring to FIG. 3, another exemplary embodiment will be described. This is a case where the controller 30 checks a new instruction related to an image forming operation and performs a mode selection when the new instruction is received while the image forming apparatus 1 is performing an image forming operation in the high-speed mode. FIG. 3 is a flowchart representing the process of selecting a mode of image forming operation when the image forming apparatus 1 receives a new instruction related to an image forming operation while performing an image forming operation.

The controller 30 of the image forming apparatus 1 according to the present exemplary embodiment stores a cumulative number of sheets, which is the number of sheets on which images are to be formed in the current image forming operation.

While the image forming apparatus 1 is performing the current image forming operation in the high-speed mode, the controller 30 receives a new instruction related to an image forming operation, which is input by a user, through the PC 3, the user interface 50, or the like (step S201).

Then, the controller 30 determines whether or not the sum of the cumulative number of sheets and a specified number of sheets is equal to or smaller than the threshold, the specified number of sheets being the number of sheets S on which images are to be formed due to the new instruction received in step S201 (step S202).

If the determination in step S202 is "YES", that is, the sum of the cumulative number of sheets and the specified number of sheets is equal to or smaller than the threshold, the controller 30 makes the image forming apparatus 1 continue the image forming operation in the high-speed mode (step S203). That is, the image forming operation due to the new instruction is performed in the high-speed mode in succession to the current image forming operation.

On the other hand, if the determination in step S202 is "NO", that is, the sum of the cumulative number of sheets and the specified number of sheets is larger than the threshold, images are formed for the cumulative number of sheets in the current image forming operation, and the high-speed mode is finished (so-called "cycle down" is performed) (step S204). Subsequently, an image forming operation due to the new instruction is performed in the normal mode (step S205).

In the description above, if the determination in step S202 is "NO", the high-speed mode is finished (step S204), and the image forming operation due to the new instruction is performed in the normal mode. However, the exemplary embodiment is not limited thereto. For example, images may be formed in the high-speed mode for the number of sheets that is equal to the difference between the cumulative number of sheets and the threshold, the cumulative number of sheets being the number of sheets on which images are to be formed in the current image forming operation. Subsequently, so-called "cycle down" is performed, and then a part of the image forming operation that is to be performed due to the new instruction and that was not performed in the high-speed mode may be performed in the normal mode. In other words, a part of the image forming operation due to the new instruction may be performed in the high-speed mode and the remaining part may be performed in the normal mode.

Plural Thresholds

In the description above, there is only one threshold. However, the exemplary embodiment is not limited thereto. For example, the threshold may differ in accordance with the size of the sheet S, the characteristics of the sheet S, and the transport direction of the sheet S.

Figure 4:
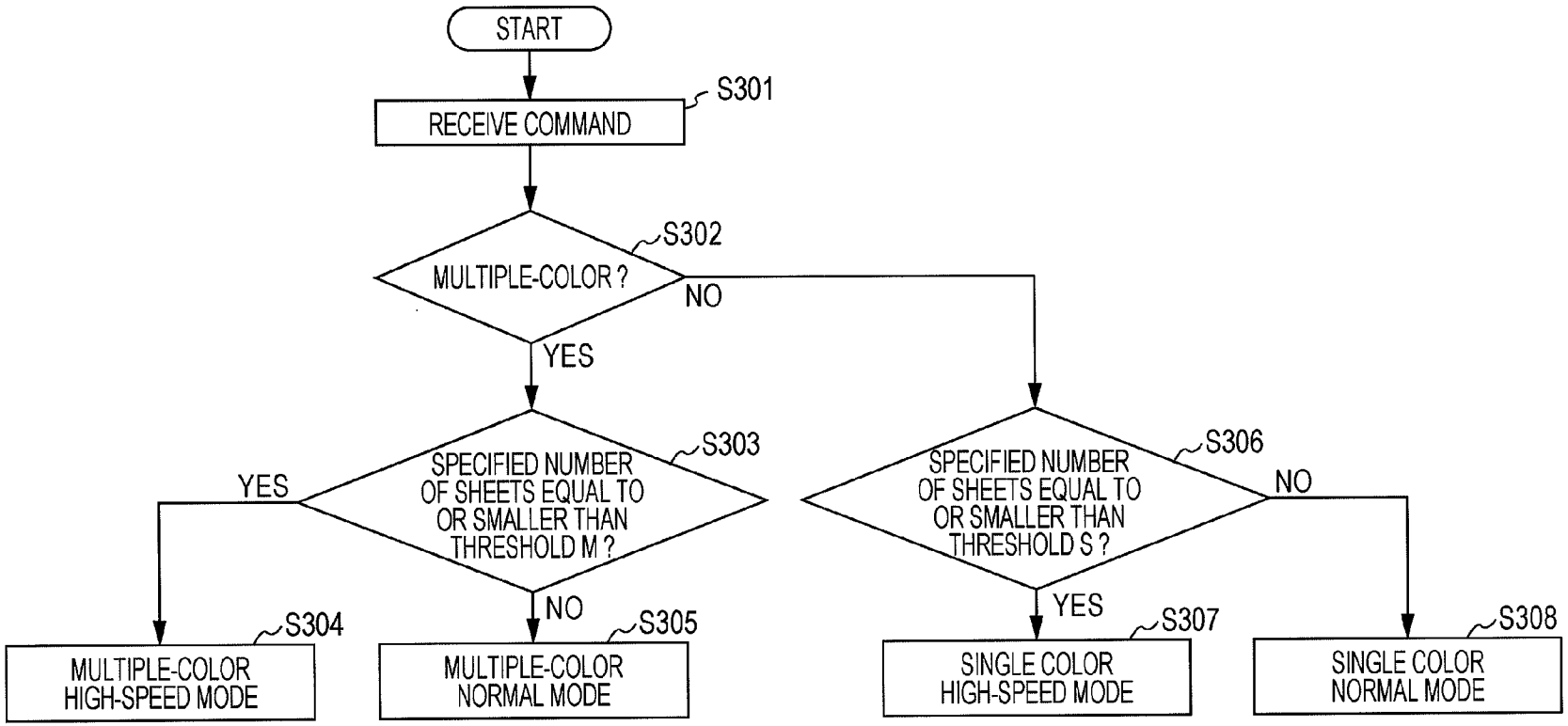
FIG. 4 is a flowchart representing a process of selecting a mode of image forming operation when a threshold for a single-color image forming operation is different from a threshold for a multiple-color image forming operation.

Moreover, the threshold may differ depending on whether the image to be formed on the sheet S is a single-color image or a multiple-color image. Referring to FIG. 4, the process of selecting a mode of image forming operation performed by the image forming apparatus 1 will be described. FIG. 4 is a flowchart representing the process of selecting a mode of image forming operation performed by the image forming apparatus 1 in the case where the controller 30 has different thresholds depending on whether an image to be formed is a single-color image or a multiple-color image. Here, for simplicity, a state in which the image forming apparatus 1 is not performing an image forming operation will be described.

First, when the image forming apparatus 1 is not performing an image forming operation, the controller 30 receives an instruction related to an image forming operation, which is input by a user, through the PC 3, the user interface 50, or the like (step S301).

Then, the controller 30 checks the instruction received in step S301, and determines whether or not an image to be formed is a multiple-color image (step S302).

If the determination in step S302 is "YES", the controller 30 checks the instruction received in step S301, and determines whether or not the specified number of sheets, which is the number of sheets S on which images are to be formed, is equal to or smaller than a threshold M, which is the threshold for multiple-color (step S303). If the determination in step S303 is "YES", the controller 30 performs an image forming operation in a multiple-color high-speed mode (step S304). If the determination in step S303 is "NO", the controller 30 performs an image forming operation in a multiple-color normal mode (step S305).

If the determination in step S302 is "NO", the controller 30 checks the instruction received in step S301, and determines whether or not the specified number of sheets, which is the number of sheets on which images are to be formed, is equal to or smaller than a threshold S, which is the threshold for single-color (step S306). If the determination in step S306 is "YES", the controller 30 performs an image forming operation in a single-color high-speed mode (step S307). If the determination in step S306 is "NO", the controller 30 performs an image forming operation in a single-color normal mode (step S308).

For example, when forming a black-and-white image, which is a single-color image, the threshold S may be 10. When forming a color image, which is a multiple-color image, the threshold M may be 5.

For example, when forming a color image, it is necessary to fix toner of plural colors. Therefore, the temperature of the fixing device 60 may be set at a higher temperature that that when forming a single-color image. In this case, the temperature of the image forming section 10 or the temperature inside the image forming apparatus 1 increases by a larger degree than when forming a black-and-white image. Therefore, in such a case, the single-color threshold S is set smaller than the multiple-color threshold M.

In FIG. 4, four modes, i.e., a single-color high-speed mode, a single-color normal mode, a multiple-color high-speed mode, and a multiple-color normal mode are illustrated. Because these four modes are independent from each other in accordance with the characteristics of image forming operation, the process speeds in these modes may be set independently. Therefore, the process speeds may differ from each other, or, for example, some of the process speeds, such as those for the single-color normal mode and the multiple-color high-speed mode, may be the same.

Other

In the description above, the high-speed mode and the normal mode differ from each other in the process speed. However, the high-speed mode and the normal mode may differ from each other also in the following respects.

That is, in order to further speed up the high-speed mode, in addition to increasing the process speed, the time from when the controller 30 receives an image forming instruction to when starting transportation of the sheet S may be made shorter than that in the normal mode. Moreover, the time from when the controller 30 receives an image forming instruction to when starting exposure may be made shorter than that in the normal mode.

Figures 5A, 5B:
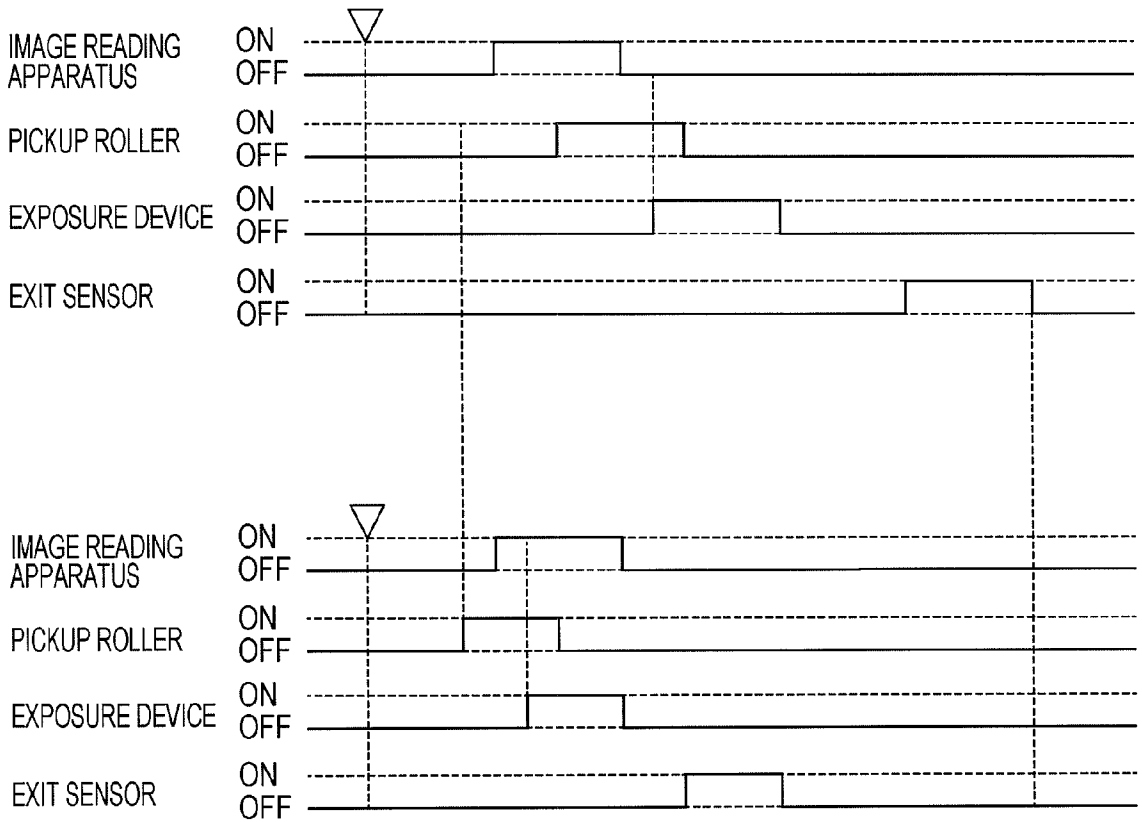
FIGS. 5A and 5B are timing charts illustrating the operations of components of the image forming apparatus.

Referring to FIGS. 1 , 5A and 5B, the details will be described. FIGS. 5A and 5B are timing charts illustrating the operations of components of the image forming apparatus 1. FIG. 5A is a timing chart for the normal mode, and FIG. 5B is a timing chart for the high-speed mode. Here, a case where image data is obtained by the image reading apparatus 4 and an image is formed on one sheet S will be described.

First, referring to FIG. 5A, an operation in the normal mode will be described.

The controller 30 receives an instruction to start an image forming operation, which is input by a user, through the PC 3, the user interface 50, or the like (see the triangle in FIG. 5A). When receiving the instruction, the controller 30 issues an instruction to the image reading apparatus 4 to read an image. Moreover, when receiving the instruction, the controller 30 issues an instruction to the pickup roller 58 to feed a sheet S. When the image reading apparatus 4 has read the image and the pickup roller 58 has fed the sheet S, the exposure device 14 starts exposure. An electrostatic latent image, which is exposed by the exposure device 14, is developed to form a toner image. The toner image is transferred to the sheet S, which has been fed by the pickup roller 58. The sheet S is detected by the exit sensor 61 and stacked on the output sheet stacker 45, which is disposed in the output section of the image forming apparatus 1.

Next, referring to FIG. 5B, an operation in the high-speed mode will be described. Here, only the difference from the normal mode of FIG. 5A will be described.

As described above, the process speed is higher in the high-speed mode than in the normal mode. Therefore, the time in which the components operate, such as the time in which the pickup roller 58 continues the "ON" state, is shorter than that for the normal mode illustrated in FIG. 5A. Note that, in the present exemplary embodiment, the operation speed of the image reading apparatus 4, the time at which the image reading apparatus 4 starts reading an image, and the time in which the image reading apparatus 4 is driven (the state in which image reading apparatus is "ON" in FIGS. 5A and 5B), are the same for the high-speed mode and the normal mode.

When receiving an instruction, the controller 30 issues an instruction to the pickup roller 58 to feed a sheet S. The controller 30 issues the instruction to the pickup roller 58 at a time faster than that for the normal mode. Moreover, the time at which the pickup roller 58, which receives the instruction from the controller 30, starts feeding the sheet S is faster in the high-speed mode than in the normal mode (see the broken line extending from the section for the pickup roller in FIGS. 5A and 5B).

Furthermore, the time from when the pickup roller 58 starts feeding the sheet S to when the exposure device 14 starts exposure is faster in the high-speed mode than in the normal mode. In the normal mode illustrated in FIG. 5A, the exposure device 14 starts exposure after the image reading apparatus 4 has finished reading an image (see the broken line extending from the section for the exposure device in FIG. 5A). In contrast, in the high-speed mode illustrated in FIG. 5B, the exposure device 14 starts exposure before the image reading apparatus 4 finishes reading of the image (see the broken line extending from the section for the exposure device in FIG. 5B).

Moreover, the time at which detection of the sheet S by the exit sensor 61 finishes, that is, the time at which the sheet S on which the image is formed is output to the output section of the image forming apparatus 1, is faster in the high-speed mode than in the normal mode (see the broken line extending from the section for the exit sensor in FIGS. 5A and 5B).

Thus, the operation is faster in the high-speed mode than in the normal mode.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit that forms an image on a sheet;

a receiving unit that receives a command that makes the image forming unit form an image; and a controller that controls the image forming unit so that the image forming unit forms an image on a sheet at a first image forming speed if a number of sheets on which images are to be formed due to the command is larger than a threshold and controls the image forming unit so that the image forming unit forms an image at a second image forming speed if a number of sheets is equal to or smaller than the threshold, the second image forming speed being higher than the first image forming speed.

2. The image forming apparatus according to claim 1, wherein the threshold includes a first threshold and a second threshold that is smaller than the first threshold, and wherein the controller uses the first threshold when the controller makes the image forming unit form a single-color image due to the command and uses the second threshold when the controller makes the image forming unit form a multiple-color image due to the command.

3. The image forming apparatus according to claim 1, wherein the command includes a first command and a second command that is received after the first command, and wherein, when the receiving unit receives the second command while the image forming unit is forming an image at the second image forming speed due to the first command, the controller controls the image forming unit so that the image forming unit forms images to be formed due to the second command at the first image forming speed if a total number of sheets is larger than the threshold and controls the image forming unit so that the image forming unit forms images to be formed due to the second command at the second image forming speed if a total number of sheets is equal to or smaller than the threshold, the total number of sheets being a sum of a number of sheets on which images are formed due to the first command and a number of sheets on which images are to be formed due to the second command.

4. The image forming apparatus according to claim 1, further comprising:

a sheet stacker on which sheets to be supplied to the image forming unit are stacked, wherein, in a case where a number of sheets is equal to or smaller than the threshold, a time from when the receiving unit receives the command to form an image to when a sheet stacked on the sheet stacker is supplied to the image forming unit is shorter than in a case where a number of sheets is larger than the threshold.

5. An image forming apparatus comprising:

a receiving unit that receives a command to form an image;

an image forming unit that forms an image on a sheet with a first image forming operation or a second image forming operation, the first image forming operation giving a higher priority to suppressing an increase in temperature while forming an image than to reducing a time from when the receiving unit receives the command to when a sheet on which an image is formed due to the command is output to an outside of the image forming apparatus, the second image forming operation giving a higher priority to reducing a time from when the receiving unit receives the command to when a sheet on which an image is formed due to the command is output to the outside of the image forming apparatus than to suppressing an increase in temperature while forming an image; and a controller that controls the image forming unit so that the image forming unit forms an image on a sheet with the first image forming operation if a number of sheets on which images are formed due to the command is larger than a threshold and controls the image forming unit so that the image forming unit forms an image on a sheet with the second image forming operation if a number of sheets is equal to or smaller than the threshold.

6. The image forming apparatus according to claim 5, wherein the controller controls the image forming unit so that the image forming unit forms an image on a sheet at a first image forming speed in the first image forming operation and so that the image forming unit forms an image on a sheet at a second image forming speed in the second image forming operation, the second image forming speed being higher than the first image forming speed.

7. An image forming method comprising:

receiving a command to form an image; and forming an image on a sheet at a first image forming speed if a number of sheets on which images are to be formed due to the command is larger than a threshold and forming an image at a second image forming speed if a number of sheets is equal to or smaller than the threshold, the second image forming speed being higher than the first image forming speed.

* * * * *